United States Patent [19]

Brown

[11] Patent Number: 4,853,112

[45] Date of Patent: Aug. 1, 1989

[54] LOW VELOCITY AIR CLASSIFIER

[76] Inventor: Victor Brown, 2208 Shadowdale, Houston, Tex. 77043

[21] Appl. No.: 223,440

[22] Filed: Jul. 25, 1988

[51] Int. Cl.[4] ..... B07B 4/00

[52] U.S. Cl. ..... 209/142; 209/135; 209/139.1; 209/154; 209/471; 241/79.1; 406/151

[58] Field of Search ..... 209/134–139, 209/139.1, 149, 140, 142, 471, 479, 502, 20, 506; 241/19, 24, 79.1; 406/12, 93, 168, 151

[56] References Cited

U.S. PATENT DOCUMENTS

| | | | |
|---|---|---|---|
| 135,571 | 4/1873 | McNeal | 209/142 |
| 650,670 | 5/1900 | Day | 209/134 |
| 1,139,484 | 5/1915 | Bryan | 209/137 |
| 2,026,633 | 1/1936 | Haworth | 209/502 |
| 3,739,893 | 6/1973 | Kaufmann | 209/137 X |
| 3,815,178 | 6/1974 | Goldman | 209/137 X |
| 3,836,085 | 9/1974 | Brown | 209/3 X |
| 4,089,422 | 5/1978 | Harmke et al. | 209/137 |

*Primary Examiner*—Robert B. Reeves
*Assistant Examiner*—Donald T. Hajec
*Attorney, Agent, or Firm*—Allegretti & Witcoff, Ltd.

[57] ABSTRACT

Apparatus for separating heavy from light constituents in coarse comminuted municipal waste having a relatively small inlet duct connecting to a much larger air classifying chamber. A by-pass duct is disposed alongside the chamber, and connects thereto at its upstream and at its downstream end. Dameprs are provided to adjust the velocity of airflow through the chamber and by-pass duct depending upon the density of the light weight constituents.

11 Claims, 3 Drawing Sheets

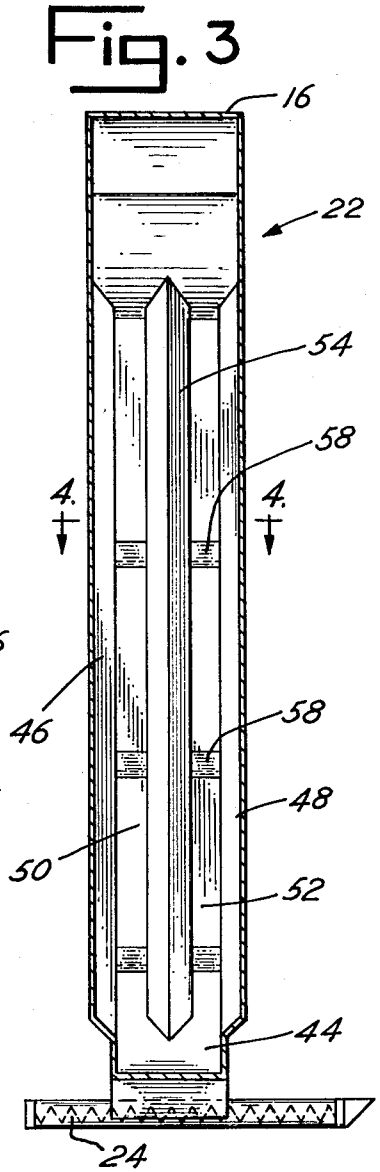
Fig. 3
Fig. 4
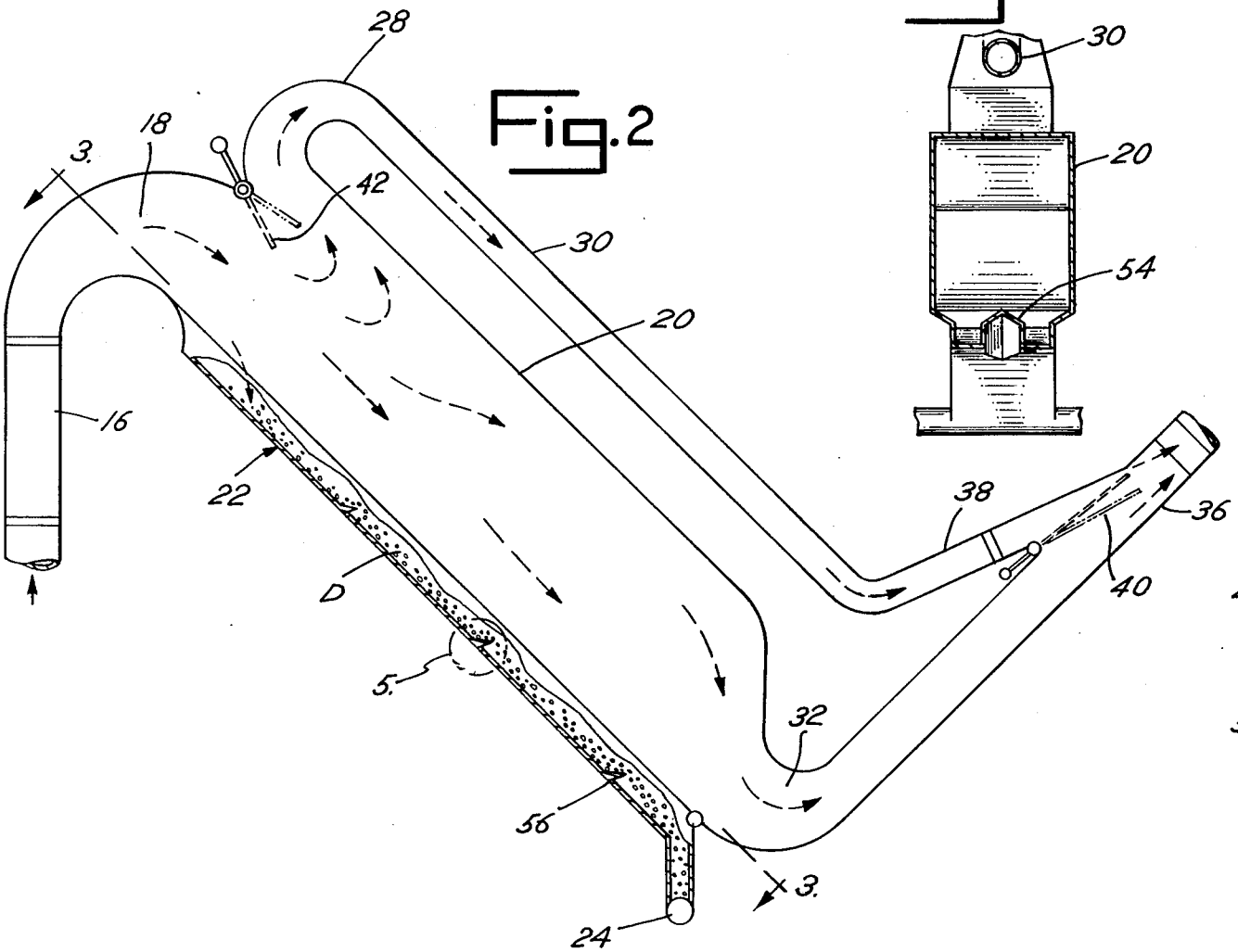
Fig. 2

LOW VELOCITY AIR CLASSIFIER

This invention relates to an improved apparatus for separating heavy constituents from light constituents in coarse comminuted municipal waste. The lightweight constituents comprising paper, plastic and fiber are valuable as a fuel source. The heavy constituents can be recycled. The use of this apparatus can ease the immense national daily disposal problem.

BACKGROUND OF THE INVENTION

An apparatus of this type is described in U.S. Pat. No. 3,836,085 dated Sept. 17, 1974. This apparatus has been in commercial operation. Shredded municipal waste may be fed into the tower extractor described in that patent either mechanically by conveyor or pneumatically. The waste material fed to the extractor consists of the product resulting from shredding large volumes of municipal solid wastes or the like to a controlled range of particle sizes. This feed stock constituting urban discard with which the invention deals consists of a wide mixture of materials such as paper, stone, plastic film, glass, metal, textiles, etc. representing a wide variation in particle density. The apparatus utilizes a stream of air to separate the lighter from the heavier constituents.

The previously patented tower extractor proved and established the efficacy of low velocity separation of particles having dissimilar density and shape comprising a shredded heterogeneous matrix. However, the apparatus needed improvement with respect to sharpness of separation, production flow rate and controllability. There was no provision for varying the air flow rate, particularly necessary when the composition of the feed stock changed.

SUMMARY OF THE INVENTION

The present invention is designed to more efficiently and effectively separate the low and high density particles as a means of extracting a light or low density fraction which by the nature of the feed material is composed essentially of combustible material ideally useful as a fuel source to industry.

High density particles separated from the low density or light particles are carried to other separation steps where this fraction made up essentially of metal, glass, stone, ceramic, etc. is accumulated and further processed. The present invention provides the primary step in material classification based on particle shape and density leading to an effective production of recyclable products from the waste material. Society has taken a strong stand that our vast urban discard, responsible for the immense daily disposal problem, must preferably and to its utmost be usefully recycled. As compared to the prior apparatus, the invention improves separation quality, production flow rate and especially control. Because the present invention permits control of air flow characteristics in the separating system, it serves as a low velocity air classifier.

"Critical Air Velocity" (expressed in feet per minute) for a conveyor system carrying bulk material is the minimum air mass velocity required to maintain every particle of a bulk matrix airborne. The air mass volume moving at critical velocity (expressed in cubic feet per minute) establishes the weight carrying capacity of a given pneumatic conveying system. Classification of waste material in accordance with my invention is accomplished primarily by controlling air velocity. The weight carrying capacity of the pneumatic conveying system in which the low velocity air classifier functions is regulated through its air volume capacity at a critical air velocity.

The critical air velocity in any given pneumatic system varies for different materials based upon particle density and particle configuration. Single substance bulk materials such as wheat or powdered coal have readily determinable critical air velocities because the particle size is generally uniform. The widely heterogeneous shredded municipal waste has great variation in particle density and also in particle configuration, ranging from a piece of shredded paper to a small round stone. The critical air velocity for pneumatically conveying shredded material waste is that velocity required to carry the highest density and heaviest compact shaped particle present in the matrix.

The basic principle in low velocity air classification is therefore based on a controlled sudden lowering of air velocity for a short time interval within the pneumatic conveying system, which causes the higher density particles of compact mass shape to fall out of the air stream. The fallout occurs when the velocity of the air stream falls below the critical velocity of the high density particles. The interval of lowered air stream velocity is controlled critically to carry only lighter particles of lower density and/or of thin, flat shapes. In the waste matrix, these represent desirable material for combustion.

For aiding the separation function the configuration of the apparatus of the invention is designed to cause drastic and sharp lowering of the air velocity for a short interval permitting massive fallout of heavy particles. These heavier particles will then, in turn, form a gravity separated fraction which automatically and continuously discharges from the air stream and drops into the unique collecting trough of the low velocity air classifier. The construction of the apparatus of the invention and its advantages are described below in conjunction with the drawings.

THE DRAWINGS

FIG. 2 is an enlarged view similar to that of FIG. 1 showing the low velocity chamber and associated parts.

FIG. 3 is a sectional view taken along the line 3—3 of FIG. 2.

FIG. 4 is a sectional view taken along the line 4—4 of FIG. 3.

Figure 6:
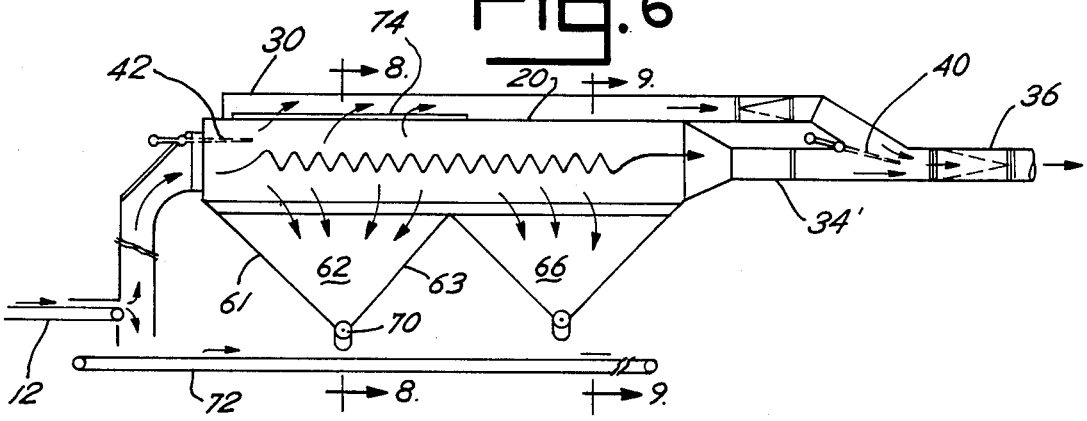
FIG. 6 is a diagrammatic side elevational view of a modified form of the invention.
Figure 8:
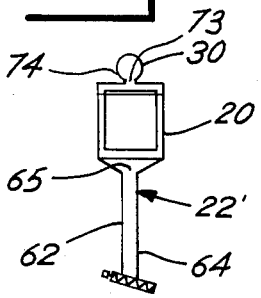
FIG. 8 is a sectional view taken along the line 8—8 of FIG. 6.
Figure 9:
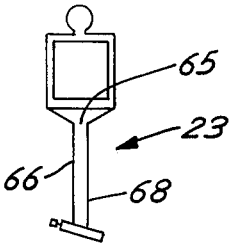
Figure 10:
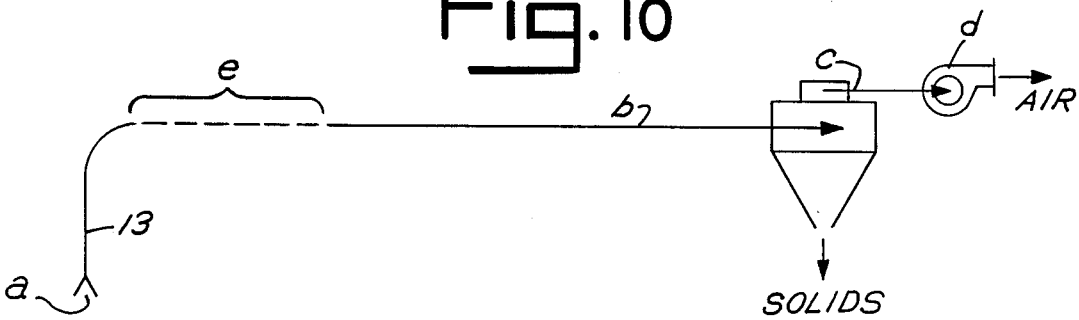

FIG. 9 is a sectional view taken along the line 9—9 of FIG. 6. FIG. 10 is a diagrammatic view of a penumatic system in which the air classifier of the present invention is used. This apparatus is designated by the letter e.

DESCRIPTION OF PREFERRED EMBODIMENT

Figure 1:
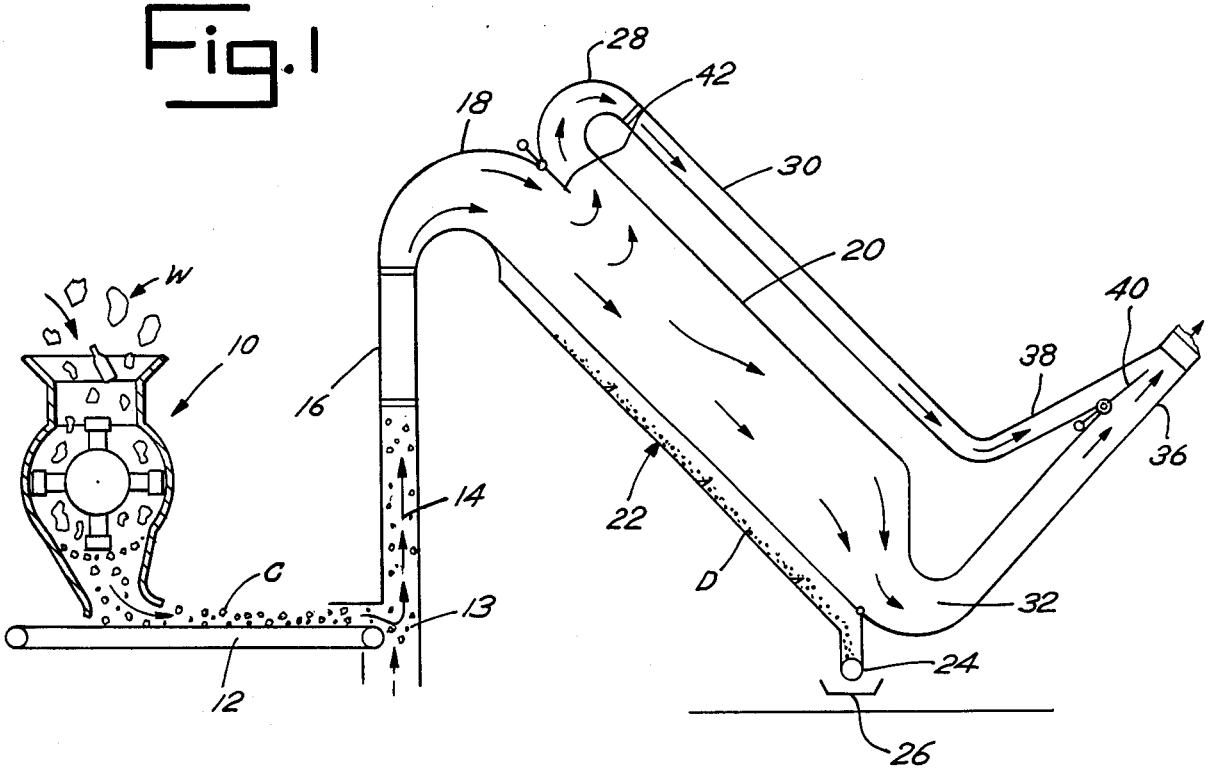
FIG. 1 is a diagrammatic side view partially in section of the apparatus constructed in accordance with the invention.

Referring to the overall view of the apparatus of the invention as shown in FIG. 1, a shredding device 10 is provided to shred whole waste material to reduce substantially the particle size. A belt conveyor leads the comminuted material C from the shredding device to the air inlet duct 16 of the air classifier. Duct 16 connects to suction pick-up duct 13 upstream of the air classifier. As shown in FIG. 10, the air classifier apparatus e of the invention is inserted in the vacuum line b between suction pickup a and cyclone separator c. The downstream side of cyclone c connects to a large squirrel cage suction fan d, which pulls air through the system. The inlet duct 16 connects to a curved transition circuit 18 of gradually increasing diameter which in turn connects to the inlet end of the low velocity air chamber 20. In this particular form of the invention, the air chamber is inclined at an angle of about 45° from the horizontal and can be increased to 60°. The chamber 20 has a rectangular cross section as best shown in FIG. 4. A collecting floor in the nature of a trough 22 is disposed in the bottom of the chamber 20 and is described in more detail below. The collecting floor is designed to catch dense particles D which fall out of the air stream, slide down the trough and are conveyed by the screw conveyor 24 onto a belt conveyor 26 for further processing.

Connecting to the top of the air chamber 20 opposite the inlet duct 16 through a goose neck 28 is a by-pass duct 30 which runs parallel to the longitudinal axis of chamber 20. The chamber 20 terminates at its exit end in a reducing transition 32. Downstream of the end of transition 32 is a discharge duct 36 of reduced diameter which connects in a Y configuration with the outlet 38 of the by-pass duct 30. A damper 40 pivotally mounted at the confluence of the ducts 36 and 38 is adjustable to permit the outlet 38 to be fully closed or fully open. Damper 40 can block the outlet duct 36 only partially and should not reduce the airflow therethrough more than 50%. A hinged flap 42 is pivotally mounted at the joint where the transition conduit 18 meets the goose neck 28. The flap is adjustable and works in conjunction with the damper 40 to increase or decrease the velocity and nature of airflow within the chamber 20. In this way, the point at which particles fall out of the comminuted material C can be controlled. The damper 40 and the flap 42 supplement the velocity decrease which is attributable to the increase in the cross section of the chamber 20 as compared with inlet duct 16. The velocity of the air at the outlet 36 preferably is approximately equal to the velocity of the air in the inlet duct 16.

Figure 5:
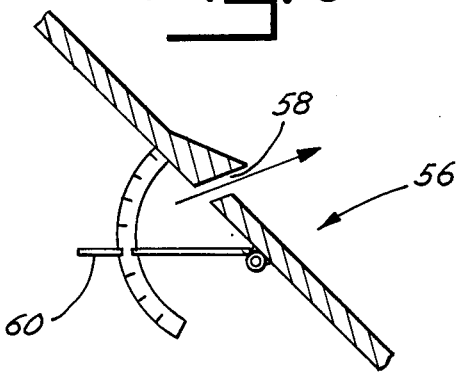
FIG. 5 is a sectional enlarged view taken through one of the riffles disposed in the collection trough in the bottom of the low velocity air chamber.

FIGS. 2–4 illustrate in detail one embodiment of the collecting floor 22. This floor consists of a trough 44 having side walls 46 and 48. A central ridge 54 separates the trough into a pair of parallel depressions or chutes 50, 52. Longitudinally spaced along the bottom of the trough 44 is a series of riffles 56 shown in detail in FIG. 5. Each riffle comprises a slot 58 through which atmospheric air is sucked into the trough 44. An adjustable damper 60 is provided to control the amount of air permitted to flow through the slot 58. The air entering the trough through the riffles lifts momentarily the heavy constituents D from the bottom of the trough and serves to release any trapped lightweight particles within the heavy construction D.

PRACTICAL OPERATION

In operation municipal solid waste W which has a general size range between 1 and 36 inches in cross section is charged into the shredding device 10 to reduce the particle size by shredding, shearing and grinding action. The more finely divided particles C are discharged from the shredding device onto the conveyor belt 12 which carries them to the pickup 13 of high velocity air stream 14 within the duct 16. The air is sucked into the system through pickup a (FIG. 10) and pickup duct 13. The comminuted material C is lifted at its critical air velocity within the duct until it enters the low velocity air classifier 20 at the inlet end thereof. The chamber 20 may be positioned at any angle between 0° and 60° with respect to the horizontal. The sudden increase in cross sectional area causes the air stream to slow down and the heavier particles D in the matrix to fall onto the collecting floor 22. The inclination of the floor 22 permits the high density particles to slide down to the lower end where they are conveyed by a screw conveyor onto a belt conveyor 26. The slope of the collecting floor may vary between 20° and 60° from horizontal and complement the position and angle of the low velocity chamber 20. The flow of air coming into the chamber through the riffles 56 lifts the high density particles momentarily from the surface of the trough and purges any light low density particles which may have become trapped. These light particles escape into the main down flowing air stream moving through the chamber 20. The air stream coming into the trough through the riffles 56 is generated by virtue of the constant partial vacuum existing within the entire pneumatic system. The velocity of the air stream entering through the riffle may be controlled by the damper which in turn is dictated by the nature of the material being processed. The screw conveyor 24 serves not only to convey the heavy particles to the belt 26, but also acts as an air lock during operation for avoiding uncontrolled air intrusion into the air classifier.

The cross sectional area of the duct 16 compared to the cross sectional area of the chamber 20 has a fixed ratio between 1:2 and 1:10. The velocity of the air is inversely proportional to this ratio. The curve of the transition conduit guides the particulate material C so that it enters the chamber 20 approximately parallel to the central axis thereof. The cross sectional size of the goose neck 28 increases additionally the cross sectional dimensions of the low velocity chamber 20. The respective cross sectional openings of the goose neck 18 and the transitional conduit 28 will vary in ratio depending upon the classification specifications. Their combined cross-sectional areas establishes the operational cross sectional area of the low velocity chamber 20.

The purpose of the by-pass duct 30 is to direct air quickly from the low velocity chamber 20 and to provide a means for further decelerating the air flow within the chamber. The flow, however, is controllable by the damper 40 as well as the hinged flap 42. The manner in which the dampers are adjusted is determined by the nature of the material passing through the apparatus. If the lightweight constituents of the matrix C have a high proportion of heavier particles, as for example, wet paper, the volume of air must be increased to keep these particles entrained in the air. On the other hand, if the combustible portion is light, fluffy and dry, the volume and velocity of the air can be correspondingly reduced using the dampers. Of course, the air adjustment must be proper to effect the separation of the particles D. The combination use of the flap 42 and the damper or control vane 40 can be adjusted to effectively change the volume of the air being by-passed from 0 to 50% of the total air flow. Without the damper system, the velocity would be fixed solely by the cross sectional differential between the inlet duct 16 and the low velocity chamber 10. The combination provides both a fixed reduction, plus an additional variablycontrolled reduction of air flow velocity within the chamber 10.

The positioning of the goose neck 28 at the point opposite the inlet to the chamber 20 avoids as much as possible interference with the airborne stream of heterogeneous waste particles flowing into the chamber 20 while, at the same time, removing air from that stream. Other positions for the connection to the by-pass conduit 30 without removing the waste particles will be obvious to those skilled in the art.

By adjusting the damper 40 and the flap 42, it is possible to control directly the fallout of high density particles D. Control is important for classifying under differing specifications when supplying fuel to various types of boilers, to cement kilns, or under varying conditions of moisture content seasonally affecting overall density of the municipal solid waste. The controls afford the means for consistently maximizing quality of the product and/or the economics of recycling wastes.

ADDITIONAL EMBODIMENT

Referring now to FIGS. 6–9, the low velocity air chamber 20 is disposed horizontally and the trough or collecting means comprises a pair of slots 65 in the bottom of the chamber 20. The slots lead to V-shaped chutes having parallel narrowly-spaced sidewalls 62, 64 (FIG. 8) and inclined bottom 61, 63 which meet at the screw conveyor 70 disposed in the bottom of the collector. In FIG. 6, there are two collectors or troughs which are substantially the same in configuration. The downstream trough has sidewalls 66, 68 connecting with the slot 65 in the bottom of the chamber 20. The other parts are essentially the same as those described above with respect to FIGS. 1–5. The belt conveyor 72 disposed beneath the screw conveyors 70 receive the discharged heavy constituents D and carries them away for further processing. The operation of the apparatus in FIGS. 6 through 9 is the same as that described with respect to the first embodiment.

Figure 7:
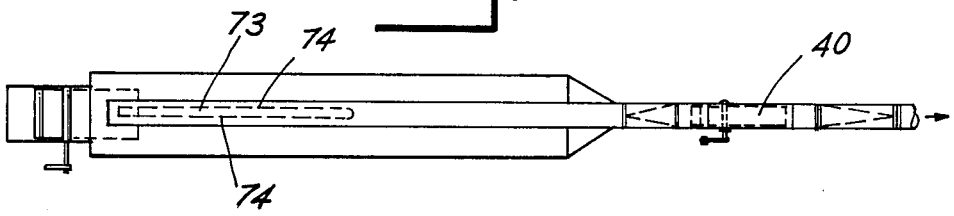
FIG. 7 is a top view of the apparatus of FIG. 6.

In this configuration, air flow into the by-pass duct 30 from chamber 20, is through elongated openings 73 through their respective walls at the inlet end of chamber 20 as best shown in FIGS. 6 and 7. The openings through the wall of chamber 20 and the wall of by-pass duct 30 are connected by means of a collar 74. The length of the opening 73 is approximately one-half the length of the chamber 20.

From the foregoing description, it is clear that by reason of the control provided in the apparatus of the invention, it is possible to increase and sharpen the time interval of a distinct velocity deceleration without having to rely on massive fixed structural differentials. The air velocity is controllable without jeopardizing the system's material carrying integrity. The apparatus provides a unique positive high density particle fallout and collection means. The apparatus is capable of meticulously separating the heavier particle fraction automatically and continuously. Furthermore, the invention provides to waste fuel recovery operators a mechanism for adjusting the apparatus continuously during daily operation to assure the system is delivering the full available fuel fraction at the desired specified quality level.

What is claimed is:

1. An improved apparatus for continuously separating lightweight combustible constituents from heavy constituents of mixed solid municipal waste comprising (a) an elongated chamber having an inlet opening at one end thereof and an outlet opening at the opposite end thereof, (b) a trough connecting to the bottom of said chamber, said trough having a discharge opening for said heavy constituents, (c) means for removing the heavy constituents from said discharge opening, (d) an air inlet duct connecting to said inlet opening of said chamber, said inlet duct being of smaller cross section than the cross section of said chamber, (e) a suction fan connecting to said outlet opening to provide an air stream through said apparatus, including said inlet duct, (f) means for feeding said waste into said air stream to entrain waste particles in said stream, (g) a by-pass duct separate from and substantially parallel to said chamber connecting to the upstream end of said chamber adjacent said inlet opening, and adjacent the outlet opening at the downstream end of the chamber, and (h) a damper disposed at the downstream end of said by-pass duct to adjust the volume of air flowing through said by-pass duct.

2. The apparatus of claim 1 which includes a second damper disposed between the inlet opening of said chamber and said by-pass duct for adjustably regulating air flow into said by-pass duct.

3. The apparatus of claim 1 in which the ratio of the cross sectional area of said inlet opening to the cross sectional area of said inlet duct ranges from 2:1 to 10:1.

4. The apparatus of claim 1 in which said trough is divided into a plurality of parallel depressions separated by a central ridge or ridges.

5. The apparatus of claim 1 or claim 4 which includes a plurality of spaced riffles disposed in the bottom of said trough and a slot in said bottom below each of said riffles.

6. The apparatus of claim 5 which includes a damper for each said slot to control air flow through said slot.

7. The apparatus of claim 1 in which said outlet opening has a cross sectional area approximately equal to the cross sectional area of said inlet duct.

8. The apparatus of claim 1 in which said chamber is disposed horizontally and said trough discharge opening has opposed inclined side walls which feed said heavy constituents into a conduit connecting to said removal means.

9. An improved apparatus for continuously separating lightweight combustible constituents from heavy constituents of mixed solid municiple waste comprising (a) an inclined elongated chamber having an inlet opening at the upper end and an outlet opening at the lower end, (b) a trough for receiving said heavy constituents in the bottom of said chamber, said trough being divided into a plurality of longitudinally extending parallel slots and having a discharge opening at the lower end thereof, (c) an inlet duct connecting to said inlet opening of said chamber, said inlet duct being of smaller cross section than the cross section of said chamber, (d) a suction fan connecting to said outlet opening to provide an air stream flowing through said apparatus, including said inlet duct, (e) means for feeding said waste into said air stream to entrain waste particles in said stream, (f) a by-pass duct separate from and substantially parallel to said chamber connecting to the top of said chamber opposite said inlet opening and adjacent said outlet opening at said lower end of the chamber, (g) a damper disposed at the confluence of said by-pass duct and said outlet opening to adjust the relative proportions of air flow through said by-pass duct and said outlet, and (h) means for removing said heavy constituents from said discharge opening of said trough.

10. The apparatus of claim 9 in which said chamber is inclined at an angle not greater than 60° from the horizontal.

11. The apparatus of claim 1 in which said damper is adjustable in one position to close completely said by-pass duct and in another position to close said outlet to reduce the air flow therethrough no more than 50%.

* * * * *